US008240075B1

(12) United States Patent
Mullin

(10) Patent No.: US 8,240,075 B1
(45) Date of Patent: Aug. 14, 2012

(54) ADJUSTABLE BASES FOR SIGHTING DEVICES

(76) Inventor: James K. Mullin, Grand Junction, CO (US)

( * ) Notice: Subject to any disclaimer, the term of this patent is extended or adjusted under 35 U.S.C. 154(b) by 78 days.

(21) Appl. No.: 12/930,697

(22) Filed: Jan. 13, 2011

(51) Int. Cl.
*F41G 1/38* (2006.01)

(52) U.S. Cl. ..... 42/125; 42/119; 42/122; 42/126; 42/136; 42/73

(58) Field of Classification Search ..... 42/119, 42/122, 124, 125, 126, 127, 135–139, 111, 42/73
See application file for complete search history.

(56) References Cited

U.S. PATENT DOCUMENTS

| | | | | |
|---|---|---|---|---|
| 2,857,816 | A * | 10/1958 | Patrick et al. | 89/41.19 |
| 5,787,630 | A | 8/1998 | Martel | |
| 5,813,159 | A | 9/1998 | Kay et al. | |
| 6,199,286 | B1 * | 3/2001 | Reed et al. | 33/265 |
| 6,295,754 | B1 | 10/2001 | Otteman et al. | |
| 6,594,938 | B2 | 7/2003 | Horton | |
| 6,598,333 | B1 | 7/2003 | Randazzo | |
| 6,629,381 | B1 | 10/2003 | Keng | |
| 6,640,481 | B1 | 11/2003 | Williams, Jr. | |
| 6,662,486 | B2 | 12/2003 | Komberger | |
| 6,708,439 | B1 | 3/2004 | Laitala | |
| 6,772,550 | B1 | 8/2004 | Leatherwood | |
| 7,121,037 | B2 | 10/2006 | Penney | |
| 7,140,143 | B1 | 11/2006 | Ivey | |
| 7,243,456 | B2 | 7/2007 | Williams et al. | |
| 7,264,227 | B2 * | 9/2007 | Miller et al. | 254/331 |
| 7,305,789 | B2 | 12/2007 | Frost | |
| 7,543,405 | B1 | 6/2009 | Ivey | |
| 7,624,526 | B2 | 12/2009 | Paasikivi et al. | |
| 7,640,688 | B2 | 1/2010 | Oz | |
| 7,647,720 | B1 | 1/2010 | Vendetti | |
| 7,654,029 | B2 | 2/2010 | Peters et al. | |
| 8,127,484 | B2 * | 3/2012 | Matthews et al. | 42/90 |

FOREIGN PATENT DOCUMENTS

WO WO 2008/099351 A1 8/2008

OTHER PUBLICATIONS

Boyle, "Darpa's Self-Aiming 'One Shot' Sniper Rifle," Popular Science, Oct. 1, 2010—posted at www.popsci.com/technology/article/2010-10/aiming-help-snipers-lockheed-developm.
MIL-STD-1913 (AR), "Dimensioning of Accessory Mounting Rail for Small Arms Weapons," U. S. GVT., Feb. 3, 1995.
Guthrie, "Rail Crazy: Picatinny Rail Basics," Shooting Times, downloaded Jan. 6, 2011 from www.printthis.clickability.com/pt/cpt?/expire=&title=Rail+Crazy%3A+Picatinny+Rail....
Anon., "NATO Accessory Rail," Wikipedia, downloaded Jan. 5, 2011 fromhttp://en.wikipedia.org/wiki/NATO_Accessory_Rail.
Anon, "NATO countries finalise plans for a standard rail adaptor system," Janes May 20, 2009, extract down. Jan. 6, 2011 from www.janes.com/news/defence/sytems/idr/idr090520_1_n.

(Continued)

*Primary Examiner* — Michael David
(74) *Attorney, Agent, or Firm* — James K. Poole, Esq.

(57) ABSTRACT

An adjustable base for attaching a sighting device such as a telescopic sight to a rifle or other ballistic projectile launcher, comprising upper and lower rails pivotally attached at the muzzle ends thereof, is disclosed. Adjustments are provided for altering the angle between the sight and the weapon's boreline or similar axis in elevation in increments of minutes of arc or fractions thereof.

11 Claims, 7 Drawing Sheets

OTHER PUBLICATIONS

Anon, "Weaver rail mount," Wikipedia, downloaded Jan. 5, 2011 from http://en.wikipedia.org/wiki/Weaver_rail_mount.

Anon, "Plastic injection molding with Polyphenylene Sulfide (PPA) plastic," Rebling Plastics, downlaoded Jan. 5, 2011 from www.reblingplastics.com/polyphenylene-sulfide.htm.

Anon, "When Good Scopes Go Bad—Making the Difficult Diagnosis" Sep. 25, 2010, Accurate Shooter, http://bulletin.accurateshooter.com/2010/09/when-good-scopes-go-bad-making-thedifficult-diagnosis/.

* cited by examiner

ADJUSTABLE BASES FOR SIGHTING DEVICES

BACKGROUND

1. Field of the Invention

The present invention relates generally to apparatus and methods of attaching and aligning weapons accessories such as an optical targeting or alignment system to a base. More particularly, certain embodiments pertain to apparatus and methods for attaching and aligning optical sighting systems to ballistic launchers. More specifically, an embodiment pertains to adjustable mounting systems for telescopic sights.

2. Discussion of Relevant Art

William Malcolm is credited with building the world's first production rifle scopes, in 1855. He was first to offer an adjustable ocular lens. His windage and elevation adjustable mounts moved the entire tube to align vertical and horizontal crossed hairs within the tube with the point of impact at a set selected distance. A limited number of recent products and patents in this area have addressed the assembly that connects the rifle to the telescopic sight. Most have involved the internal functions of the telescopic sight.

The modern tactical rifle scope is more than an evolutionary development. By any measure it is revolutionary. It may utilize as many as ten separate lenses in light's path from the objective (front) lens to the ocular (rear) lens. Crossed hairs have morphed into spider web and wire, then into etched glass. Fixed magnification power has yielded to amazing variable power magnification systems. The one challenge that presents itself as a constant, from the earliest developments until now, is the matter of reconciling point of aim with point of impact on either side of the one point on a bullet's ballistic arc where the shooter has "zeroed in his scope". Cartridge makers have long published charts which show inches of drop at regular distances from the muzzle for each of their bullet-load combinations. The military has adopted Minutes Of Arc (MOA) for adjusting sights vertically to account for the effects of gravity on a bullet's trajectory.

Today's long distance shooter uses technology beyond the imagination of William Malcolm. For example, Knight's Armament offers a ballistic computer application for the ubiquitous Apple Ipod®. A user's selection of a bullet (or cartridge) from a database of a listed manufacturer's products offers a menu of various calibers and profiles. The user input of the range to target is combined with altitude derived from the Ipod's internal GPS. Other factors like temperature and barometric pressure are factored into the calculations for the distance a projectile will fall before striking a target. Advanced software can even consider the Coriolis Effect from the earth's rotation. Once the calculations are complete and all the factors are considered, the output from the device is displayed on the LCD screen in minutes of angle, the familiar MOA. The shooter simply twists the top dial (graduated in minutes of angle) as directed to shift the aiming point to reflect the amount the rifle's muzzle must be tilted upward to launch the bullet on a ballistic arc that will intersect with the line of sight at the exact range entered.

It is what happens inside the scope that is more often than not a bigger mystery than the Ipod computer functions. A tactical rifle scope contains many parts for what, on the surface, appears to be a fairly simple device. The three major parts of a telescopic sight are far more complex than the casual user might imagine. The heart of an MOA adjustable scope is an erector tube within the main barrel of the scope. A minutes of angle ratio and proportion can be concealed within the barrel of the scope. The up or down movement of a plunger at the rear of the erector tube divided by the distance between the erector tube's front pivot point and the plunger yields a very special number, the sine of the angle the erector tube is inclined from the barrel axis. That angle is expressed as the now-familiar "MOA."

When the erector assembly is parallel to the main scope tube, (the "zero" or neutral position) the light's path through the scope is direct, symmetrical and free from distortion. It is only when the long range shooter begins twisting the adjustment knobs that the laws of physics conspire to compromise his hope for "one shot, one kill." A socket machined at the front of the typical scope tube and a matching ball formed on the outside of the erector tube form a mechanical joint known as a trunnion. A spring fixed below the rear of the erector tube provides the return pressure acting against the force of a threaded stem that winds down with the user's twisting of the elevation adjustment.

The path of light through the scope now follows a much different route. As the erector assembly is tilted and the magnification lenses within the erector separate, the laws of refraction must be obeyed. Light projected onto the rear focal plane and the trailing lens is perpendicular to the axis of the rear magnification lens. The deflection angle produces angular distortion. The path of light is not along the centerline of the lens. The asymmetrical aspect through the rear lens creates refraction distortion. Thus, no matter how mechanically precisely the MOA adjustment compensation is introduced into the erector tube, the throughput is an optical approximation. Furthermore, another adjustment in the scope's objective lens assembly for parallax can reduce accuracy again.

Further distortion may be introduced into the erector tube with any serious adjustment for windage. Light that passes from lens to lens off center in both X and Y axes (i.e., horizontal and vertical) will result in spherical aberration as well.

The mechanism at the rear of the erector tube that tilts the assembly is vulnerable to damage or deterioration with repeated use. The spring on the opposite side of the adjustment screw and plunger tube provides the essential force required to return the tube to the neutral position or less than neutral for shots at less than the pre-set "zero" point. Since they are engineered for a limited number of duty cycles, every part in such systems will eventually wear out. Each erector tube assembly has a limited range of adjustment. A shooter working near the limits of the system's envelope is often tempted to squeeze one more minute of angle from the scope's limited range of motion. But if he over-torques the MOA knob, internal parts will fail. For a bench shooter competing for bragging rights at a 1,000 yard competition, scope failure is something that has happened to you before or will happen one day soon. See, e.g. the recent article "When Good Scopes Go Bad—Making the Difficult Diagnosis," published Sep. 25, 2010 in ACCURATE SHOOTER, accessible online at http://bulletin.accurateshooter.com/2010/09/when-good-scopes-go-bad-making-the-difficult-diagnosis/. At best, this might be considered a minor inconvenience. At worst, the competitive shooter may watch someone else walk of with "his" prize. However, for the hunter or shooter engaged in combat, the stakes are much higher. The shooting community is rampant with anecdotal horror stories of telescopic sights failing in accordance with "Murphy's law" after repeated adjustments.

It is well known to provide mechanical means for adjusting the elevation of sighting and ranging devices mounted to a base. Aiming or sighting devices, laser target illumination devices and laser ranging devices are commonly mounted to ballistic projectile launchers, such as rifles, and to other apparatus requiring adjustment along a longitudinal axis. Common aiming or sighting devices include various types of telescopic optical scopes. Other aiming or sighting devices include telescopic and non-telescopic thermal imaging scopes and telescopic and non-telescopic amplified light imaging optical scopes.

Adjustable mounting systems are frequently used to mount telescopic scopes, and similar aiming devices, upon the barrels of rifles or similar firearms. The most common telescope sights are non-amplified, optical devices having front and rear mounting points. Such telescopic sights are typically attached by means of mounting systems to the barrels of rifles or similar weapons by means of a mounting system to the barrel of a rifle in a configuration having the rear sight of the scope adjacent to the rifle's breech and the front sight of the scope directed toward the muzzle. The scope's sighting axis is approximately aligned with the bore axis of the rifle and is adjusted vertically in elevation and adjusted laterally in windage such that the point of aim observed by the shooter is the point of impact of the projectile at the desired range. Other elevation and windage adjustments may be necessary based upon a number of well known factors in including wind speed and direction, temperature, humidity, projectile shape and mass, and powder mass and burn characteristics. Since projectiles follow a ballistic path, adjustments in elevation may be a critical factor or hitting targets at ranges approaching the maximum range of the particular cartridge-rifle combination.

The amounts of elevation adjustments needed for telescopic sights mounted on high powered sporting and military rifles frequently exceed the amounts of adjustment achievable by the elevation adjustment mechanisms within the telescopic sight itself. Furthermore, the internal adjustment mechanisms of most telescopic sights are less accurate over the outer limits of their adjustment ranges. The internal adjustment mechanisms are frequently positioned such that a shooter in the firing position cannot easily reach the controls and cannot readily read the adjustment markings. Additionally, the internal adjustment mechanisms of telescopic sights my be inadvertently displaced by the acceleration experienced during recoil and other shocks. Adjustable mounting systems are used to mount telescopic sights to provide for greater amounts of elevation adjustments and greater resistance to displacement of the elevation adjustment mechanisms during recoil or other shocks.

Some target shooters have employed tapered ramps, wedges or shims that fit between scope and rifle to externally adjust the elevation of the scope relative to the barrel without using the existing internal scope mechanisms. These wedge shapes are machined in increments of ten to twenty minutes of angle to extend the range of a scope beyond the manufacturer's upper limits of internal adjustment. However, for every yard added on the long end the shooter gives up three feet on the short side.

A very large part of exacting marksmanship is confidence in one's equipment. Function and endurance are the measure of each part of the total system. The Military has recognized the need for a more dependable, predictable and repeatable aiming system. The recently completed Defense Advanced Research Projects Agency (DARPA) program awarded Lockheed Martin a $3.93 million contract to develop a rifle-scope attachment to enhance soldiers' marksmanship capabilities. See the article, "DARPA's Self-Aiming 'One Shot' Sniper Rifle Scheduled for Next Year," published by *Popular Science* on Oct. 1, 2010, accessible online at www.popsci.com/technology/article/2010-10/aiming-help-snipers-Lockheed-development . . . .

The Dynamic Image Gunsight Optic or DInGO system which is the objective of this project is hoped to enable soldiers to accurately view targets at varying distances without changing scopes or suffering a decrease in optical resolution. This system was recently reported on the *Defence and Airospace* news blog, accessible online at www.brahmand.com/news/Lockheed-receives-$393-min-DInGO-system-contract-from-darpa/4011/1/24.html. By the DARPA program's own definitions, the military is recognizing a problem exists—a problem they are willing to spend millions to solve. Much of what has been submitted in this competition is not yet public knowledge, but it is safe to assume that an industry invested in the existing MOA adjustable erector tube within the scope could not use an outside the box solution to the problem. More electronics and holographic reticles are not the answer. Many a soldier or bench shooter has made the observation and asked the question, "But what happens when the batteries go dead?" Keep it simple stupid, KISS for short is an apt maxim. It is safe to say that, "The concept of shifting the point of aim optically is flawed."

Assorted prior art patents reveal a number of inventors who have attempted to create mounting system for scope to rifle that would provide a mechanism to create a deflection angle between the typical parallel alignment between rifle bore and scope line of sight. All start with the premise that the scope's windage and elevation adjustment systems should be reserved for the initial task to sight in or "zero" the aiming system at a pre-set distance. Some examples use ramps or wedges, while others employ cams. Dials marked with numbers or Vernier scales suggest a level of precision that is difficult to achieve across a wide range of cartridges and bullet weights.

International Publication WO 2008/099351 discloses a sight support for a projectile launcher having a first member to be attached to the launcher and a second member pivotally connected to the first member and arranged to support a sight, with a worm drive acting between the two members to pivot them toward and apart from one another.

U.S. Pat. No. 7,121,037 discloses an adjustable scope mounting device for adjusting a scope mounted on a gun, using opposite threaded screws for elevational adjustment. FIG. 2 shows an adjusting wheel with detents which contact a pin as part of the process of measuring the amount of elevational adjustment.

U.S. Pat. No. 3,990,155 discloses a riflescope elevation adjustment assembly which reads directly in terms of target distance in addition to providing "click" type elevation settings. An external adjustment knob is provided and a distance scale is displayed on an annular flange extending from the knob.

U.S. Pat. No. 7,690,145 discloses ballistic ranging methods for determining ballistic drop of shooting a projectile to a specific target range, using a laser rangefinder and ballistic software program.

Steven Ivey has a number of patents for adjustable rifle scope mounts His U.S. Pat. No. 7,140,143 discloses an adjustable elevation mount formed from a scope ring and an adjustable sub-base. A cylindrical elevation cam and a dial thimble are used as portions of the adjustment mechanism. U.S. Pat. No. 7,543,405 is a CIP of this patent disclosing several additional embodiments.

Leatherwood's U.S. Pat. No. 6,772,550 discloses a rifle scope adjustment mechanism using a pivot point and screw-driven tilting mechanism using a spring to move the scope upward. The system can be applied to the internal components of the scope or to an external mount.

Major ammunition manufacturers have published charts that describe their product's ballistic characteristics. See, for example, the data for Remington's popular 308 round in Table I below. Note the difference in bullet drop at 500 yards between the various factory loads.

TABLE I

REMINGTON BALLISTICS CHART

| Cartridge Type | Bullet | 100 yds | 150 yds | 200 yds | 300 yds | 400 yds |
|---|---|---|---|---|---|---|
| Remington Managed Recoil | 125 | +1.1" | Zero | −2.7" | −7.4" | −38.5" |
| Premier Sirroco Bonded | 150 | +1.8" | +1.6" | Zero | −3.1" | −22.7" |
| Premier Core-Lokt Ultra | 180 | +1.9" | +1.7" | Zero | −3.4" | −25.5" |

(This data was obtained from Remington Arms website, www.remington.com/pges/news-and-resources/ballistics.aspx.)

While this information is helpful, it is just the starting point. The distance between the scope's line of sight and the rifle's bore sight is the first variable to consider. That distance must be added to the inches of drop at a given range to calculate the angle between that point out in space and the scope's line of sight. For example: a rifle scope with high mount scope bases might rise about 2.4" above the centerline of the barrel. When added to the drop published for the 168 gr Express cartridge of 78.2," the point of aim must be raised a total of 80.6" to impact the target at the required distance of 500 yards. The drop of 80.6" divided by (500 yds×3'×12") is equal to 0.004488 or the sine of zero degrees, 15 minutes and 24 seconds. Armed with only the published data, anyone with a hand held trig function calculator and a range finder who could put "the dope on the scope" could put a projectile on the target. He could, if it weren't for those problems with refraction distortion, angular distortion and parallax error and if his scope had enough adjustment left after he zeroed it in at 100 yards. That would be a problem. That is why the adjustable scope base disclosed herein is invaluable. For 15¾ MOA, one need only twist the dial a half revolution plus three clicks.

Selected MOA values required for selected cartridges at various ranges are presented below in Table II. Note that at 1000 yards, the required MOA adjustments exceed the internal adjustment capabilities of conventional optical scopes and mechanical systems such as disclosed in Ivey's U.S. Pat. No. 7,543,405.

TABLE II

Line of sight above line of bore = 3.00 inches
Adjust minutes of angle for point of aim - to point of impact

| Cartridge Type | Bullet | 100 yds | 200 yds | 400 yds | 500 yds | 1000 yds |
|---|---|---|---|---|---|---|
| Remington Managed Recoil | 125 | Zero | 3¼ moa | 9½ moa | 14¼ moa | 37½ moa |
| Premier Sirroco Bonded | 150 | Zero | 2¼ moa | 6½ moa | 9½ moa | 34½ moa |
| Premier Core-Lokt Ultra | 180 | Zero | 2½ moa | 7½ moa | 11¾ moa | 72¾ moa |

(Data in this table were calculated by Applicant from *Sierra Bullets*, a Sierra Ballistics program.)

Despite numerous efforts to provide external adjustments in the relationship of telescopic sights with relation to the boresights or similar axes of ballistic weapons launchers in elevation and/or windage (lateral movement), as evidenced by patents including those discussed above, there remains a need for a simple, rugged and reliable adjustable base for securing such sights to rifles and the like.

SUMMARY

A scope mounting base between rifle and scope will be described that provides 300 minutes of angle of adjustment—mechanically, not optically. Please recall the MOA scope's internal mechanism that inclines the erector tube within the barrel of the typical scope. The relationship between the pivot point and the distance the threaded riser stem moves, up or down, establishes an angle. The trig functions of sine & cosine reveal our familiar minutes of angle. The adjustable scope base described herein performs the same function externally without compromising the optics of the scope. A much greater range of motion permits the shooter to dial in the precise incline calculated by proprietary software or from printed data found on the box of ammunition. Refraction distortion, angular distortion and parallax error are a thing of the past. Once the scope's internal adjustment for elevation is reserved for initial sighting in, the long term durability of the high dollar glass can be measured in years, not minutes as has sometimes been the case.

Fine adjustments to the point of aim are required to place the point of impact at the one spot in space where the projectile's ballistic arc crosses the scope's line of sight at a given distance. To accomplish that task the rifle's muzzle must be tilted upward to launch the projectile on its flight path.

One aspect of the present invention is to provide adjustable bases for securing sighting systems to various weapons, with adjustment of lines of sight at least in elevation. Another aspect is to include mechanical means to removably attach such adjustable bases to accessory fixtures such as various rail designs on weapons and likewise to attach various sighting systems such as telescopic sights to attachment fixtures atop the adapters. Included in this aspect is the design of the adjustable bases to mate with attachment fixtures on both the weapons and the sighting systems on a dovetail basis, i.e. with a male component wider at its extremity than at its connection point to the main element which slides into a corresponding groove in the component to which it is to be attached so that it can be removed only by sliding in the same manner. Included in this aspect is the use of military. commercial or custom accessory rails such as the well known Picatinny and Weaver rails and more recent rails described in military standards. Another aspect is to utilize the recoil grooves atop a typical Picatinny or Weaver rail for the attachment of weapons accessories by means of pins or other fasteners extending through such grooves.

Another aspect is to provide top and bottom rails in the base which are pivotally attached together at the forward or muzzle end when installed on a weapon and adapted so that the bottom rail can be removably attached to an attachment fixture of the weapon while the top of the upper rail can be removably attached to the accessory to be mounted. Still another aspect of this structure is mechanical means for altering the position of the top rail and the sighting system attached thereto by elevating the rear or breech end of the upper rail. An aspect of this means is an index wheel rotationally attached to the bottom rail and interconnected with a threaded riser stem such that rotation of the index wheel moves the riser stem upward and forces the breech end of the upper rail upward through the movement of the threaded portion of the riser stem within a threaded hole centered in the index wheel. Another aspect is the interconnection between a head portion such as an oblong lobe on the upper end of the riser stem with a lateral pin or setscrew placed across a corresponding space such as an oblong hole in the breech end of the upper rail. Another aspect is to emplace the lateral pin so that it passes through a slot in the oblong lobe of the riser stem in such a way that the pin can slide longitudinally within the slot to maintain the vertical orientation of the riser stem as it is elevated or lowered.

In general, an adjustable base or adapter for removably attaching a sighting device to a ballistic projectile launcher comprises a lower base rail adapted for removable attachment to an upper surface of the launcher, an upper rail pivotally attached to the lower rail at the forward or muzzle end of each of these rails, with the upper rail adapted for removable attachment of the sighting device to the upper surface of the upper rail. An elevation mechanism is provided for elevating the rear (breech) end of the upper rail to depress the line of sight of the sighting device, the elevation mechanism comprising an adjustment or index wheel configured to turn a vertical threaded shaft which moves upward or downward as the wheel turns and moves the rear of the upper rail upward or downward by pressure on a lateral pin installed across a vertical recess at the rear of the rail. In a preferred embodiment, the vertical threaded shaft is a riser stem headed by an oblong lobe portion adapted to fit into a corresponding oblong vertical hole passing through the end of the upper rail and having a horizontal, longitudinal slot (preferably oblong in form) through which the lateral pin is passed in assembling the device. As the riser stem is moved upward in a "screw jack" fashion by turning the index wheel, it presses against the lateral pin to raise the end of the upper rail while the lateral pin slides within the oblong slot and allows the riser stem to maintain a vertical orientation perpendicular to the base rail even as the upper rail increases its angle relative to the base or lower rail.

In a preferred embodiment, an adjustable base comprises a bottom rail having a female groove along the bottom surface adapted to removably attach the rail to an attachment fixture on a weapon, such as a Picatinny rail, in a dovetail manner. Further, the bottom rail provides a vertical recess in the muzzle end thereof, extending between the upper and lower surfaces of the rail with lateral holes provided in each vertical side adjacent the recess to allow a portion of the muzzle end of an upper rail to be pivotally fastened to the bottom rail by mechanical means such as setscrew, pivot pin or the like. The upper rail which is to be pivotally attached to the lower rail provides on its upper surface the male or upper portion of an attachment rail such as a Picatinny rail, with a cross section adapted to slide into a dovetail groove on the underside of a sighting system such as a telescopic sight, with transverse recoil grooves and ridges to facilitate the attachment of accessories, even those which do not attach directly in a dovetail manner. In the breech end of the upper rail, a vertical, oblong hole is provided which passes from top to bottom and is adapted to accommodate an oblong lobe portion which is the head of a riser stem used to elevate the upper rail. The oblong head of the riser stem is inserted through the oblong hole in the upper rail and a lateral setscrew or pin is inserted through a horizontal (or lateral) slot in the riser stem head so that the pin can slide within this slot as the riser stem acts to elevate the upper rail. The threaded shaft of the riser stem screws into an index wheel which is rotationally secured to the lower rail to form a screw jack which is arranged to elevate the upper rail (and thus the attached telescopic sight or the like) by one minute of angle (MOA) or a fraction thereof for a specified amount of rotation. The amount of rotation, and thus the MOA of elevation, can be measured and noted as the index wheel is turned by markings on the periphery thereof, which are preferably observed at a "witness notch" on the breech end of the lower rail. Furthermore, a spring-loaded index pin impinges upon a series of serrations spaced around the lower periphery of the index wheel at specified intervals to prevent accidental rotation, while providing visual and auditory indications of each increment of rotation. Thus, given the amount of vertical adjustment in point of impact required at a given range, the shooter can use the index wheel to "crank in" the amount of elevation of the upper rail and the axis of the telescopic sight parallel thereto which is required.

Other aspects and advantages of embodiments of this invention will be apparent from the following description and appended claims, reference being made to the accompanying drawings forming a part of this specification wherein like reference characters designate corresponding parts in the several views.

BRIEF DESCRIPTION OF DRAWINGS

Before explaining the disclosed embodiments of the present invention in detail, it is understood that the invention is not limited in its application to the details of the particular arrangements shown, since the invention is capable of other embodiments. Also, the terminology used herein is for the purpose of description and not of limitation. The accompanying drawings illustrate the invention and its applications.

DETAILED DESCRIPTION OF PREFERRED EMBODIMENTS

The following description of various embodiments uses a terrestrial frame of reference in which "top" and "bottom" or "upper" and "lower" refer to the portions of an article facing away from or toward the force of gravity when arranged in what would be considered an upright position for normal use. Also, with regard to typical small arms and other hand-held weapons, the terms "breech" or "rear" and "muzzle" or "front" can be used to refer to opposite ends of the weapon. The expression "A and/or B" is used in a conventional sense, meaning that A, B or both A and B may be present.

Figure 1:
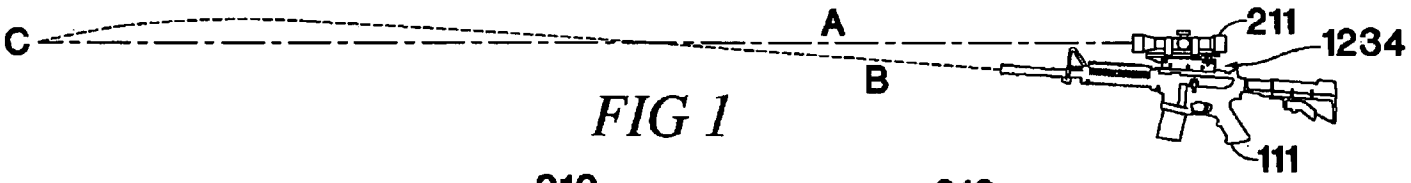
FIG. 1 is a side view of a scope-equipped rifle with line of sight and ballistic trajectory to a target.

FIG. 1 shows a rifle 10 (of the AR-15 or M-16 type) upon which a telescopic sight 11 has been mounted with an embodiment 1234 of the adjustable scope mount. The angle between the scope and the barrel axis has been adjusted so that the line of sight A and the ballistic trajectory B of the bullet meet at the distant target C.

Figure 2:
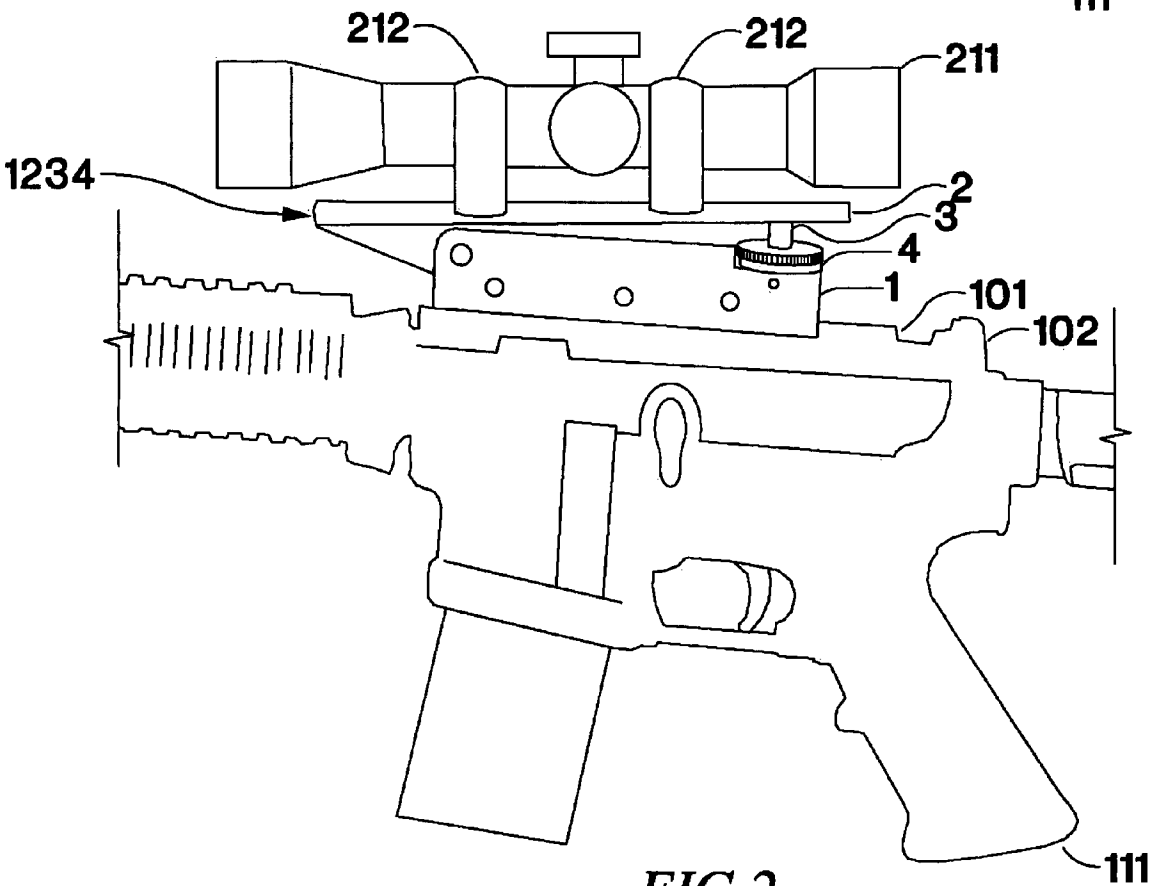
FIG. 2 is a side view of the rifle of FIG. 1 with the telescopic sight attached by an embodiment of an adjustable base.

FIG. 2 shows the attachment of scope 211 to rifle 111 using scope rings 212 and the Picatinny Rail portion of top rail 2, as described below. Bottom rail 1 of adjustable scope base 1234 is attached to a Picatinny Rail 101 atop the receiver 102 of rifle 111, as illustrated and discussed below. Riser stem 3 and index wheel 4, discussed below, are used to elevate tope rail 2.

Figure 3:
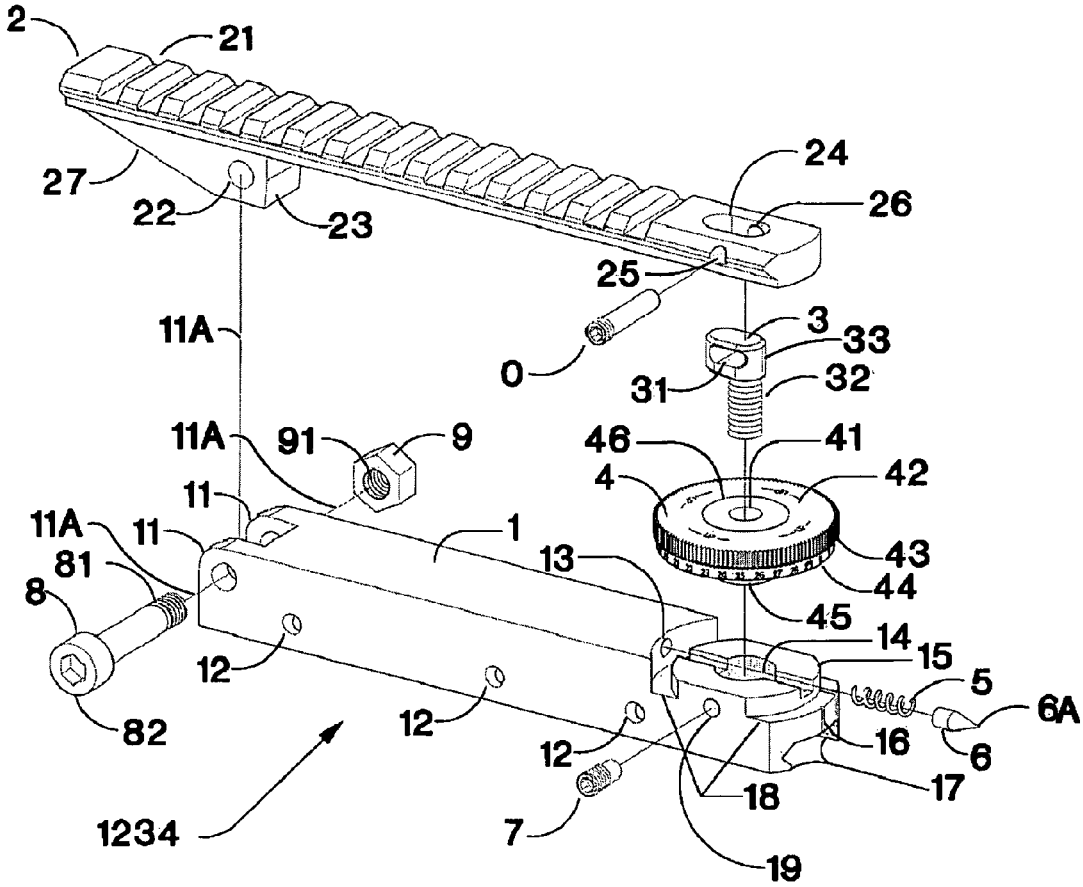
FIG. 3 is an exploded view of an embodiment of the adjustable base of FIG. 2.

An embodiment of an adjustable mounting system 1234, shown in expanded perspective form in FIG. 3, comprises a base rail 1 and top rail 2 aligned at a pivot point 11A at the common axis of holes 11, 22 and 11 connected by pivot pin 8, which is held in place by matching threads 81 on pivot pin 8 and 91 on locking nut 9, using Allen head 82. Once assembled, base rail 1 and top rail 2 are free to swing through a vertical arc generally parallel to the barrel of the ballistic launcher with which the system is used and also the attachment fixture to which base rail 1 is attached, about pivot pin 8. It is the angle formed between base rail 1 and top rail 2 which forms the vertex that establishes an incline between the line of sight of a telescopic sight attached to the top rail 2 with an attachment fixture such as the industry standard Mil-Spec 1913 Picatinny Rail System 21 and the base rail 1, which is attached to a rifle or other ballistic launcher, also typically via an industry standard Mil-Spec 1913 Picatinny Rail System 17. Top rail 2 is tilted up and away from base rail 1 at pivot pin 8 as required to install the remaining parts. Machined relief section 23 (on the underside of top rail 2 adjacent hole 22) allows for the rotation of top rail 2 without binding on base rail 1. That portion of top rail 2 below the centerline of hole 22 that contacts the end of base rail 1 is removed to prevent binding as top rail 2 pivots.

Picatinny Rail Systems as shown for this embodiment are exemplary of fixtures for attaching telescopic sights and other accessories to ballistic launchers such as rifles and are widely used, but mounting systems of the present invention can be designed and manufactured to serve as adjustable interfaces between various other commercially available rail systems or custom designed to engage with other types of fixtures if desired.

Figure 6:
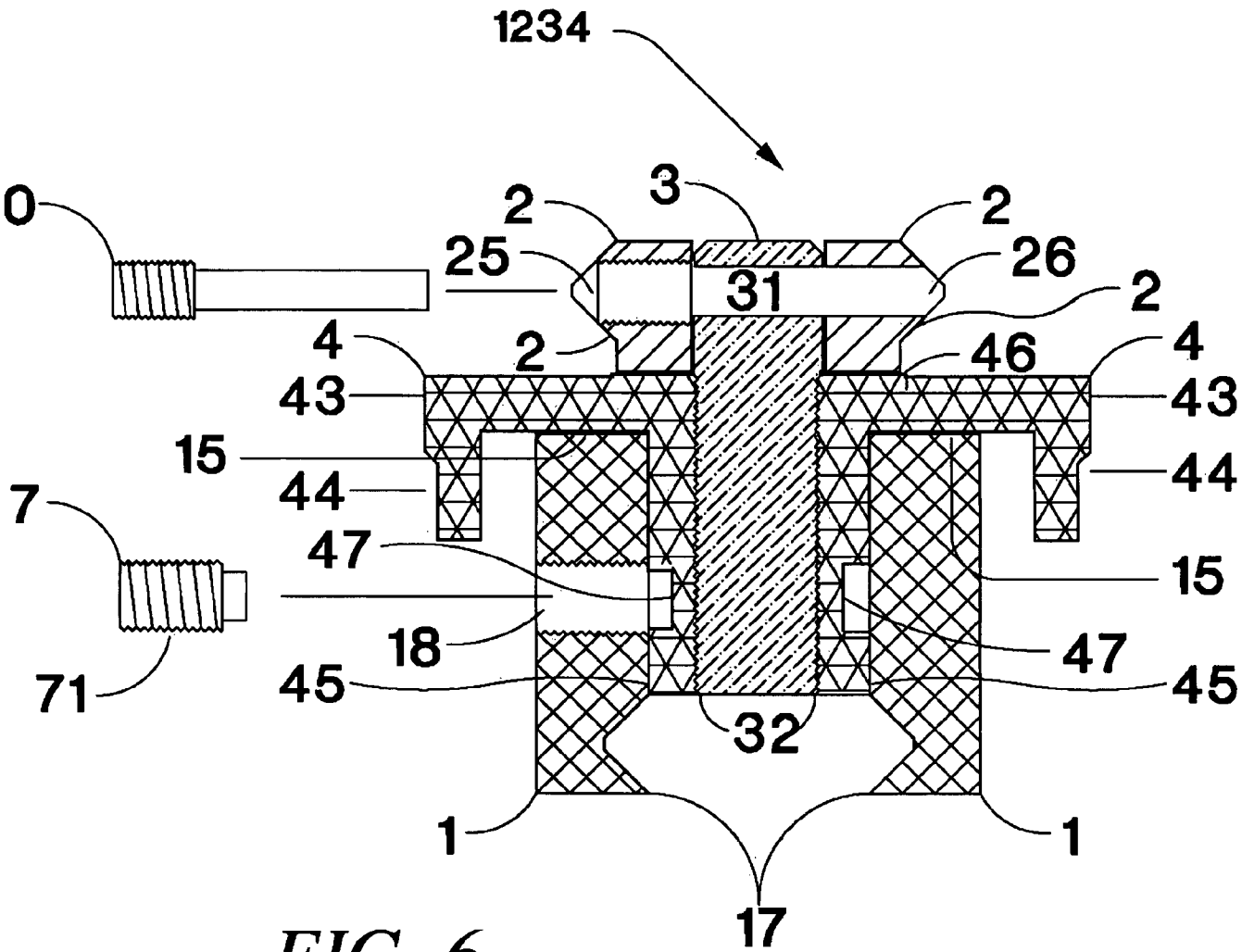
FIG. 6 is a transverse sectional view of the adjustment components of the adjustable base of FIG. 3, partially exploded.

The Picatinny Rail is a bracket used on various firearms to provide a standardized mounting system for telescopic sights and other accessories. The standard was published by the U.S. Army's Picatinny Arsenal, New Jersey, in 1995 as MIL-STD-1913, and is also known by the NATO designation STANAG 2324. Both of these standards re incorporated herein by reference. The rail is typically installed directly on the weapon's receiver in the position normally occupied by the rear sights. The rail's cross section resembles a broad "T" shape having triangular edges, which can be seen in FIGS. 3 and 6 of embodiments herein. Scopes or other accessories are installed on the rail by sliding them onto the rail from one end or the other (requiring a longitudinal groove corresponding in shape to the rail's profile, as seen in FIGS. 3 and 6 herein), or by means of "rail-grabbers" which are mechanically clamped to the rail. In general, the mounting of accessories on such rails can be described as using "dovetail joints," a version of tongue-and-groove joints used in carpentry where the tongue is roughly triangular in shape (resembling a dove's tail) so that it cannot be withdrawn from a corresponding groove once installed without sliding one piece relative to the other. To provide a stable platform for sights and the like, the rail should not flex as the weapon barrel heats and cools during use. To achieve this result, Picatinny and similar rails are cut crosswise along their upper surfaces to provide room for them to expand and contract lengthwise. The resulting ridges and "spacing" slots are standardized in width and spacing, and can be used for the attachment of accessories as described herein. These slots and spacings differ slightly between the Picatinny Rail and similar Weaver rail. Although many rail-grabber-mounted accessories can be mounted on either type of rail, it is generally the case that Weaver devices (at least those with only one locking slot) will fit on Picatinny rails, but Picatinny devices will not always fit on Weaver rails. Another difference is that Weaver rails are continuous, while Picatinny rails are cut by the slots to neutralize expansion caused by barrel heating. (See article "Rail Crazy: Picatinny Rail Basics, *SHOOTING TIMES* of July, 2007, available online at www.shootingtimes.com/optics/ST_railcrazy__200907/index.html, and in a Wikipedia description of the "Weaver rail mount," available online at http://en.wikipedia.org/wiki/Weaver_rail_mount.

It is the intent of the Applicant that the embodiments claimed herein include dovetail joints between the adjustable bases, rails installed on weapons and the grooves of accessories to be attached to the weapons via the adjustable bases. This would include rails of the Picatinny and Weaver type, newly-developed systems such as the new NATO Accessory Rail, STANAG 4694 (See NATO countries finalise plans for standard rail adaptor system, Jane's May 20, 2009, available online at www.janes.com/news/defence/systems/idr/idr090520_1_n.shtml), and later-developed or custom systems as appropriate. This can be done by fabricating bottom rails with bottom grooves to fit selected rail systems on weapons of choice and fabricating top rails to mate with the grooves on the bottoms of scopes or other accessories to be mounted on the weapon. In general, these components can be fabricated so they can be assembled together to provide pivotal adjustments as described above in the normal manner.

Similarly, although disclosed herein as installed on a rifle, embodiments of these mounting systems can be employed with any ballistic launcher where adjustment of the point of aim using telescopic or other types of sights is desirable. While these systems can be invaluable in long range rifle shooting, they can be equally valuable with shorter range launchers such as shotguns, carbines, grenade launchers and crossbows. In general, the greater the ballistic arc, the more effective these systems can be in providing the proper angle between sight and the bore or other launcher axis.

As shown in FIG. 3, spring 5 and index pin 6 are inserted into hole 13 in the breech end of base rail 1. The conical point 6A of index pin 6 serves to prevent accidental rotation of index wheel 4 by engaging one of 120 serrations 43 machined into the lower edge of index wheel 4. On the opposite (breech) end of base rail 1 from pivot pin 8, concentric shaft 45 (seen more clearly in subsequent figures) of index wheel 4 is inserted into vertical hole 14 on the raised boss 15 of base rail 1. Index wheel 4 is free to rotate about the common axis of shaft 45 and hole 14 while skirt 44 of index wheel 4 spins in, but without contacting, horizontal groove 18, which can be machined into base rail 1. Horizontal boss stop 46 is provided atop wheel 4.

The underside of index wheel 4 bears on raised boss 15 of base rail 1. Setscrew 7 is threaded into lateral tapped hole 19 in base rail 1 using threads 71. The smooth shoulders of set screw 7 extend into through hole 19 into hole 14 on the raised boss 15 of base rail where set screw 7 is secured into base rail 1 to a depth that will engage a square groove 47 machined in shaft 45 of index wheel 4 (See FIG. 6.) in such a way as to allow free rotation of index wheel 4 while restricting movement up and down of index wheel 4 relative to base rail 1. The threaded shaft 32 of riser stem 3 is then turned clockwise into vertical threaded hole 41 until the bottom side of the oblong lobe 33 at the top of threaded shaft 32 contacts the top surface of index wheel 4. Riser stem 3 is turned counterclockwise until the oblong lobe 33 at the top of threaded shaft 32 aligns with the oblong slot 24 machined into the breech end of top rail 2.

Top rail 2 is returned to an angle that matches base rail 1, i.e., parallel. Hole 25 in top rail 2 is aligned with oblong hole 31 in lobe 33 of riser stem 3. Once these portions are aligned, set screw 0 can be threaded into horizontal tapped hole 25 so that its end extends across oblong slot 24 and enters horizontal hole 26 on the other side. A drop of thread locking compound on the threads of set screw 0 will prevent accidental back out from 25. The ten main parts thus assembled complete the adjustable scope base.

In operation, as index wheel 4 is rotated, the tip of index pointer 6A follows the peaks and valleys of the serrated edges 43 of index wheel 4. Spring 5 located in hole 13 in base rail 1 is compressed behind index pointer 6 to produce tactile and auditory feedback with each three degree rotation of the index wheel 4. The ratio and proportion between the thread pitch on threaded shaft 32 of riser stem 3 and the distance between the centerline of riser stem 3 and pivot pin 8 expressed in the trigonometric sine of the angle between the top and bottom rails are adapted to incline top rail 2 exactly thirty minutes of angle with every full rotation of index wheel 4. Graduated scale 44 on the skirt of index wheel 4 provides a visual reference to the user as the laser etched numbers pass by and align with witness notch 16 in the end of base rail 1. Engraved directional arrows 42 are provided atop index wheel 4. Riser stem 3 and index wheel 4 perform the function of a screw jack to provide the precise lift required to create a deflection angle between base rail 1 and a top rail 2 of up to five degrees, or in the language of the long range shooter "300 Minutes Of Angle" or MOA. Raised boss 46 serves as a stop to prevent top rail 2 from binding on index wheel 4.

Figure 7A:
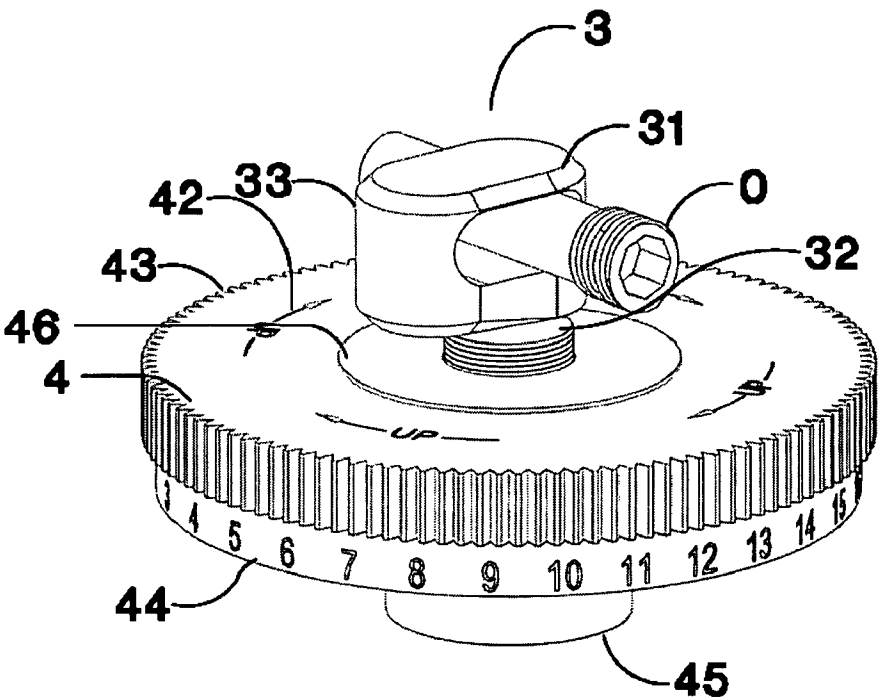
FIGS. 7A and 7B are perspective views of the index wheel-riser stem assembly showing the movement of the lateral pin within the oblong slot in the oblong lobe at the top of the riser stem.
Figure 7B:
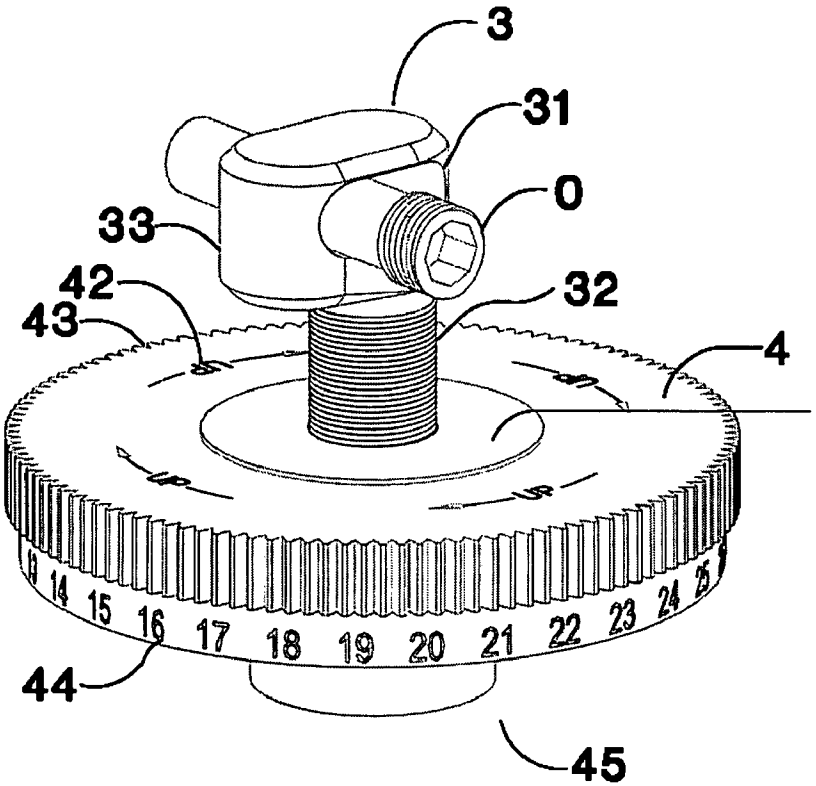

An advantageous feature of this elevation mechanism is the arrangement which allows setscrew 0 to slide within the oblong slot 31 in lobe 33 at the head of riser stem 3 during operation. As shown in FIGS. 7A and 7B, as top rail 2 is moved upward by riser stem 3 and set screw 0, the distance between pivot pin 8 in hole 22 and setscrew 0 does not change, but the point of tangential contact between setscrew 0 and oblong slot 31 in top lobe 33 shifts, allowing riser stem 3 to remain vertical (or perpendicular to base rail 1) throughout the range of motion of top rail 2. In FIG. 7A, the limited number of exposed screw threads 32 and the position of setscrew 0 within slot 31 are the alignment expected when top rail 2 is inclined a limited amount. In FIG. 7B, the large number of exposed threads 32 and the position of setscrew 0 within slot 31 are the alignment expected when top rail 2 is inclined to near its maximum. The observed shift in the position of setscrew 0 within the slot 31 is a function of the geometry of the assembly. Without this feature, only a limited amount of vertical adjustment of top rail 2 could occur before the system malfunctioned. By elevating the breech end of top rail 2 and the scope or other sighting device attached thereto, the shooter is forced to aim higher to place the sight on target, thus creating an intersection between the ballistic trajectory of the launched projectile and the line of sight at the target. This is illustrated in FIG. 1, as discussed above.

The various embodiments of this invention depart from prior art devices in their simplicity, dependability and predictability of point of aim through an optical sighting system for the point of impact for projectiles launched on a ballistic arc at any given distance.

The base rail 1 shown has been machined to provide a slot 17 (female) on the bottom surface to fit industry standard Mil-Spec 1913 Picatinny Rail Systems. Military rifles have adopted this configuration as the near-universal method of attaching all manner of accessories to small arms including rifles and pistols. Civilian applications have followed with Original Equipment Manufacturers (OEM) as well as after market applications that retrofit this profile to fit various rifles and pistols. Three drilled holes 12 in base rail 1 align with the notches of the Picatinny Rail System attached to the weapon receiver to allow the user to insert fasteners of his choice to secure the adjustable scope base to his weapon's Picatinny Rail. In FIG. 2, a telescopic sight is shown attached to a rifle in this manner. Although the interfaces between the Picatinny Rail systems atop the rifle and on top rail 2 are not clearly visible there, the notches 21 shown atop top rail 2 can be engaged by similar holes in the mounting hardware of a telescopic sight or other accessory once the grooved portion on the bottom thereof is slid over the top rail 2, engaging the characteristic form of the Picatinny Rail in dovetail fashion. Similarly, the groove 17 in the bottom surface of base rail 1 engages the exposed rail portion of the Picatinny Rail System mounted on the receiver of the weapon. The top rail 2 has been machined to Mil-Spec 1913 Picatinny Rail System (male) to serve as a universal mounting system for scope rings and other sighting systems.

Figure 4:
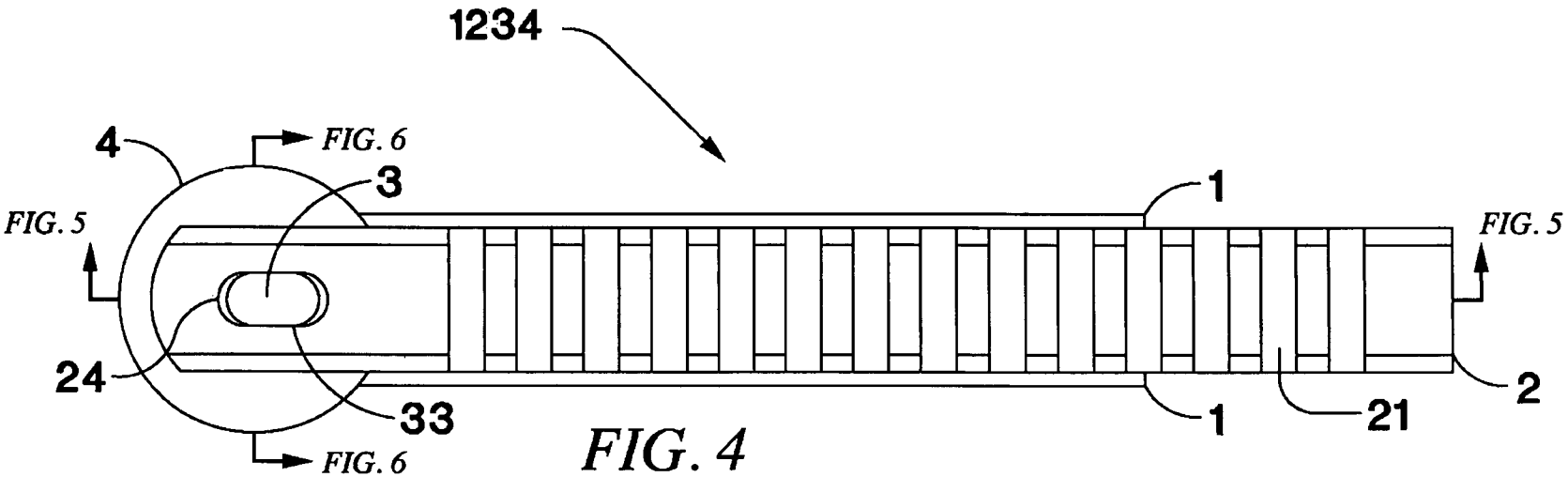
FIG. 4 is a top (plan) view of the assembled adjustable base of FIG. 3.
Figure 5:
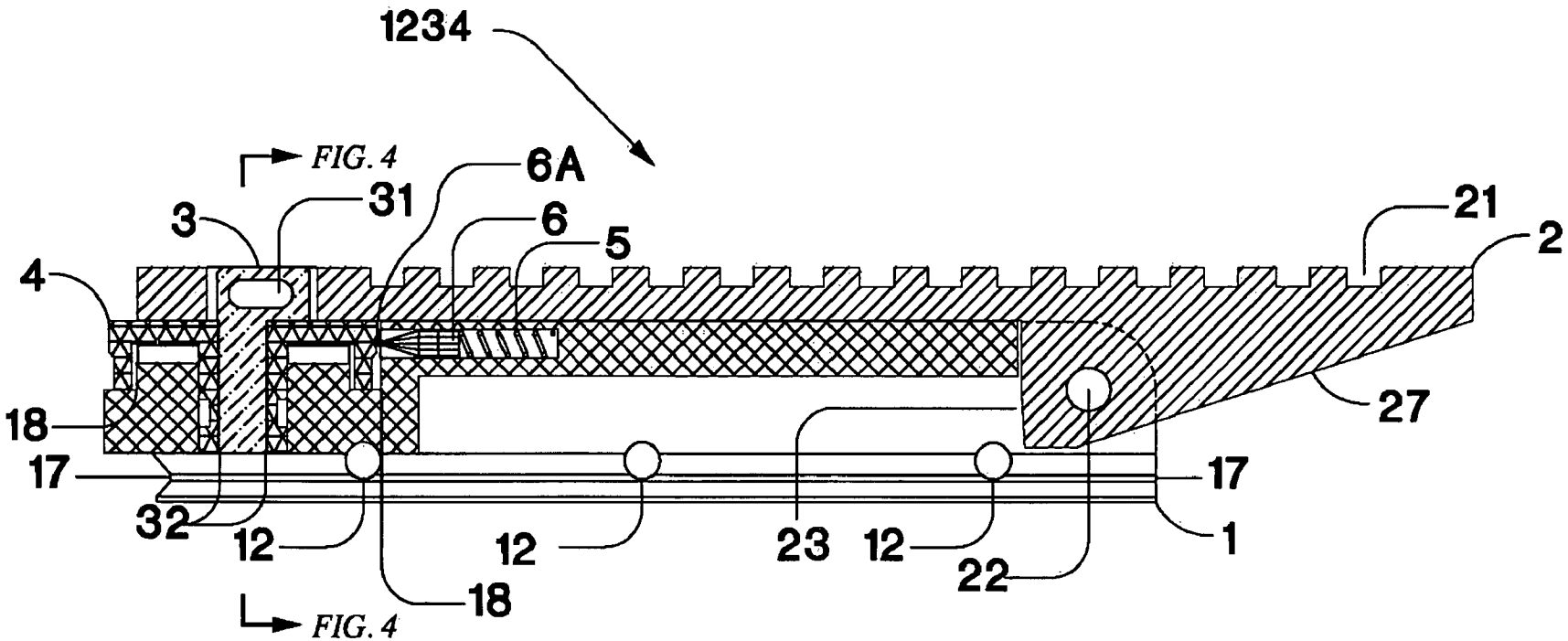
FIG. 5 is a side sectional view of the adjustable base of FIG. 3.
Figure 8:
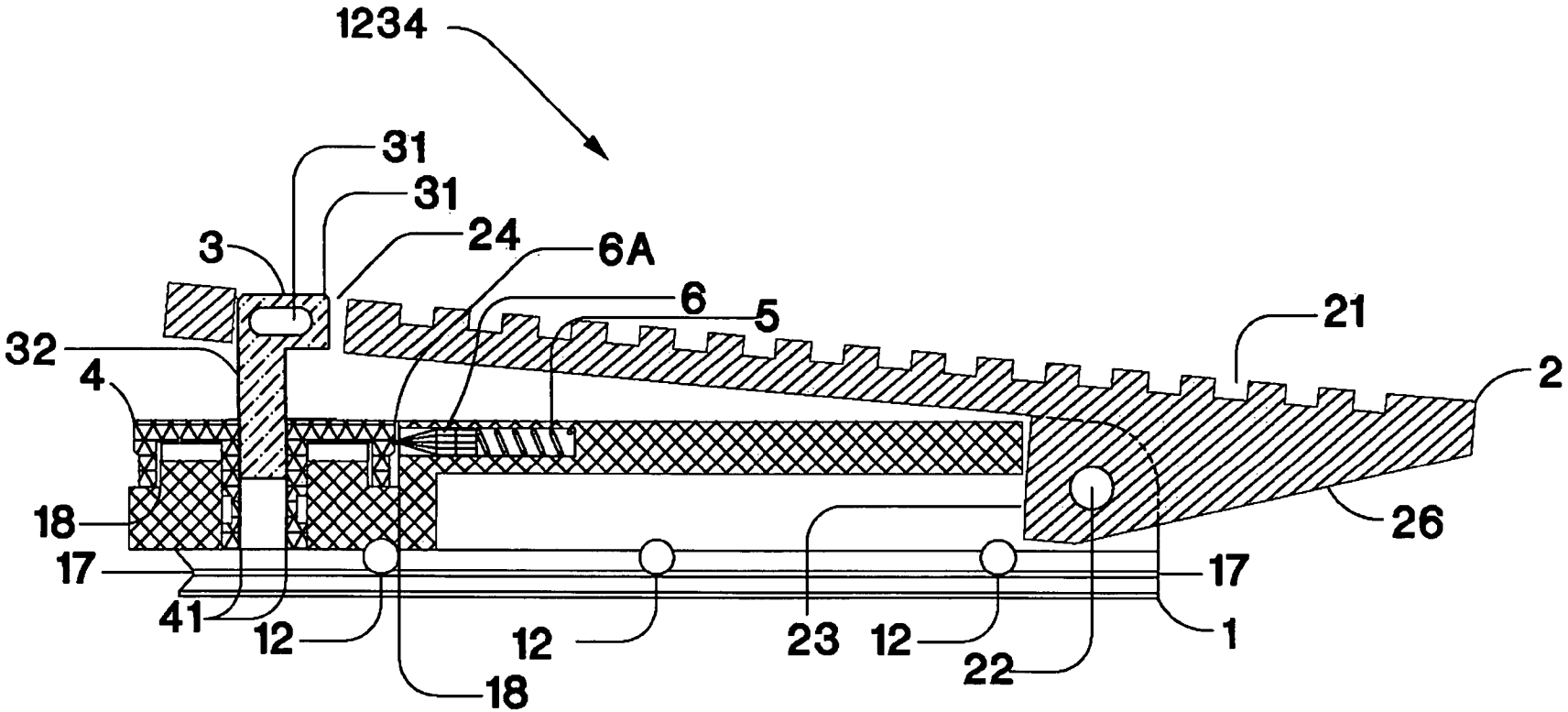
FIG. 8 is a side sectional view as in FIG. 5, with top rail 2 elevated.

The sectional views of FIGS. 4, 5 and 6 illustrate more fully how the components shown in FIG. 3 fit together and function. FIG. 8, a sectional view similar to that of FIG. 5, shows upper rail 2 elevated.

Although a specific embodiment using specific materials and fasteners has been shown, any suitable materials and means of fabrication and assembly can be used. For example, while most threaded fasteners are shown with heads containing recesses for the use of Allen wrenches, ordinary slot, hex-head or Phillips head bolts could be used. Any suitable materials can be used, including steel, aluminum and alloys thereof. Picatinny rails and similar rail systems are often produced from hard-anodized aluminum extrusions to economically produce systems which are resistant to surface corrosion and non-reflective if appropriate. Bronze and other non-ferrous metals can also be used. For some parts, polymer composites meeting the required performance characteristics could be used to reduce weight and cost. For example, polyphenylene sulfide is available in forms which are hard, strong and conduct heat well.

Although the present invention has been described with reference to certain disclosed embodiments, numerous modifications and variations can be made and still the result will come within the scope of the following claims. No limitation with respect to the specific embodiments disclosed herein is intended or should be inferred. Each apparatus embodiment described herein has numerous equivalents. The use of the adjustable holder herein in conjunction with a telescopic sight and a rifle is primarily for the purpose of illustrating and explaining one application of the invention. It is expressly understood that other applications or devices such as other ballistic weapons launchers are contemplated for use with the present invention as well. Accordingly, the disclosure of preferred embodiments of the invention is intended to be illustrative but not limiting of the scope of the invention, which set forth in the description and drawings herein.

I claim:

1. An adjustable base for attaching sighting systems to ballistics projectile launchers, comprising:

a lower base rail adapted for removable attachment to an upper surface of such launcher, an upper rail pivotally attached to the lower rail at the forward or muzzle end of each of these rails, with said upper rail adapted for removable attachment of a sighting system to the upper surface of the upper rail;

an elevation mechanism for elevating the rear or breech end of said upper rail to depress the line of sight of the sighting device, said elevation mechanism comprising an adjustment or index wheel configured to turn a vertical threaded shaft which moves upward in a screw jack fashion as said index wheel turns and moves the rear of said upper rail upward by pressure of said threaded shaft on a lateral pin installed across a vertical recess at the rear of said upper rail, wherein said threaded shaft is fitted with an oblong lobe at the top thereof, said vertical recess has an oblong shape to accommodate said oblong lobe and said lateral pin is free to move from side to side within a slot within said oblong lobe as said lobe and said upper rail are raised and lowered, such that said threaded shaft maintains a position perpendicular to said lower base rail.

2. The adjustable base of claim 1 wherein said lower rail comprises a longitudinal groove on the underside thereof adapted to mate in dovetail fashion with an attachment rail on the top surface of said launcher and the upper surface of said upper rail has a portion adapted to mate with a groove in the bottom surface of a sighting system in a dovetail fashion.

3. The adjustable base of claim 2 wherein the groove in the underside of said lower rail is adapted to mate with a Picatinny or Weaver rail on said launcher and said upper portion of said upper rail comprises the upper portion of a Picatinny or Weaver rail.

4. The adjustable base of claim 3 wherein said Picatinny or Weaver rail on the upper portion of said upper rail comprises lateral recoil grooves and ridges.

5. The adjustable base of claim 1 wherein said launcher is a rifle and said sighting system is a telescopic sight.

6. The adjustable base of claim 1 wherein said index wheel is mechanically and rotationally attached to the breech end of said lower base rail, comprises markings at predetermined intervals around its upper periphery to indicate the amount that it is turned and serrations at predetermined intervals around its lower periphery, wherein said lower base rail is fitted with a spring-loaded index pointer within its breech end forward of and adjacent to the lower periphery of said index wheel which is arranged to engage said serrations to provide visual and audible indications of each interval within which said index wheel is turned.

7. The adjustable base of claim 6 wherein the distances between the pivot point where said lower base rail and said upper rail are joined and said threaded shaft and the movement of said index wheel and said threaded shaft are arranged so that turning said index wheel through a predetermined arc raises or lowers said upper rail to alter the angle between said lower base rail and said upper rail by a minute of arc (MOA) or fraction thereof.

8. An adjustable base for attaching sighting systems to ballistic weapons launchers, comprising:

a bottom rail having a female groove along the bottom surface thereof, adapted to removably attach the rail to an attachment fixture on said launcher in a dovetail manner and a vertical recess in the muzzle end thereof, with lateral holes provided in each side of said recess to allow a portion of the muzzle end of an upper rail to be pivotally attached to said bottom rail by mechanical means;

an upper rail adapted for pivotal attachment to said bottom rail at the muzzle end of both rails and having an upper portion forming the male portion of an attachment rail, with a cross section adapted to mate with a dovetail groove on the underside of a sighting system, said upper rail further comprising a series of transverse recoil grooves and ridges on the upper surface thereof;

said upper rail further comprising at its breech end a vertical, oblong hole aligned with the longitudinal axis of said upper rail and extending between its upper and lower surfaces and adapted to accommodate an oblong lobe which is the head of a riser stem used to elevate said upper rail, with a coaligned hole on each side of the vertical portions of said upper rail adjacent said oblong hole which are adapted for the installation of a lateral pin extending across said oblong hole;

a riser stem comprising a threaded shaft and an oblong lobe forming the head thereof, said lobe comprising a lateral oblong slot adapted to be retained within the oblong hole in said upper rail by said pin;

a round index wheel mechanically and rotationally attached to the breech portion of said bottom rail, having a central threaded hole adapted to receive the threaded shaft of said riser stem and to elevate or lower said riser stem in a screw jack manner when rotated, with said lateral pin allowed to move within said oblong slot in the riser stem lobe during the movement of said riser stem to maintain the riser stem's position as perpendicular to said bottom rail;

said index wheel being marked and mechanically adapted to rotate in predetermined increments which result in movements of said riser stem which alter the angle between said upper and bottom rails, and thus said sighting device, by an amount of one minute of angle (MOA) or a fraction thereof per increment of rotation of said index wheel.

9. The adjustable base of claim 8 wherein said bottom rail is adapted to mate with a Picatinny or Weaver rail on said launcher and said upper rail forms the upper portion of a Picatinny or Weaver rail.

10. The adjustable base of claim 8 wherein said ballistic launcher is a rifle and said sighting system is a telescopic sight.

11. The adjustment base of claim 8 wherein said index wheel rotates within a vertical hole in the breech end of said bottom rail, has a series of markings along the periphery thereof to indicate amounts of rotation, and a spring-loaded index pointer is adapted to interact with serrated edges provided on the lower periphery of the base of said index wheel to indicate predetermined amounts of rotation by visible and audible means.

* * * * *